United States Patent [19]

Kawada et al.

[11] Patent Number: 4,665,578

[45] Date of Patent: May 19, 1987

[54] STREAMLINED BOX GIRDER TYPE SUSPENSION BRIDGE

[75] Inventors: Tadaki Kawada; Kenichi Maeda, both of Toyama, Japan

[73] Assignee: Kawada Kogyo K.K., Toyama, Japan

[21] Appl. No.: 846,603

[22] Filed: Mar. 31, 1986

Related U.S. Application Data

[63] Continuation-in-part of Ser. No. 614,972, May 29, 1984, abandoned.

[30] Foreign Application Priority Data

Dec. 5, 1983 [JP] Japan ..... 58-229467

[51] Int. Cl.[4] ..... E04C 3/02; E01D 11/00

[52] U.S. Cl. ..... 14/17; 14/18; 52/727; 188/378

[58] Field of Search ..... 14/1, 8–11, 14/17–23; 52/724, 725, 727; 104/89, 118, 123, 124; 188/378

[56] References Cited

U.S. PATENT DOCUMENTS

| | | | |
|---|---|---|---|
| 314,247 | 3/1885 | Jenkinson | 104/124 |
| 3,088,561 | 5/1963 | Ruzicka | 52/727 |
| 4,566,231 | 1/1986 | Konsevich | 52/727 X |

FOREIGN PATENT DOCUMENTS

| | | | |
|---|---|---|---|
| 678259 | 1/1964 | Canada | 14/17 |
| 1500829 | 10/1967 | France | 14/18 |
| 277564 | 9/1951 | Switzerland | 14/1 |
| 831893 | 5/1981 | U.S.S.R. | 14/17 |

*Primary Examiner*—Stephen J. Novosad
*Assistant Examiner*—John F. Letchford
*Attorney, Agent, or Firm*—Frishauf, Holtz, Goodman & Woodward

[57] ABSTRACT

A streamlined box girder type suspension bridge comprises a plurality of towers for supporting the cables, and the center main span and side spans comprising streamlined box girders suspended by a plurality of hangers from the cables. An additional mass of an appropriate weight comprising the material which would not directly contribute to the strength of the box girder is formed as a core at the predetermined portion of the box girder in order to suppress the bending-torsional flutter arising from the streamlined shape of the box girder, and the core extends over the complete span of the bridge symmetrically and with respect to the longitudinal axis thereof.

8 Claims, 7 Drawing Figures

"r" LOCATION OF THE ADDITIONAL MASS

STREAMLINED BOX GIRDER TYPE SUSPENSION BRIDGE

CROSS-REFERENCE TO RELATED APPLICATION

This application is a continuation-in-part of prior application Ser. No. 614,972, filed May 29, 1984, now abandoned.

BACKGROUND OF THE INVENTION

1. Field of the Invention

The present invention relates to suspension bridges and more particularly to a streamlined box girder type suspension bridge for dispersing live loads applied to a deck.

2. Description of the Prior Art

Stiffening girder type suspension bridges are generally classified into several types, the primary types of which are a box girder, a plate girder, a truss girder and the like.

Of these stiffening girder types, the stream-lined box girder type has recently been most utilized for suspension bridges of a long span for the reasons as will be described hereinbelow.

One of the advantages of the box girder type is the reduction in wind drag on the deck to one third of that for the truss girder type. Furthermore, the box girder type has higher torsional stiffness, weight for weight, than any other types and therefore is convenient to deal with aerodynamic oscillations. Still further, the steel in the box section is capable of resisting stresses in several directions simultaneously, i.e., shear, torsion, lateral bending and the like, serving to save in weight of steel and consequently to reduce the cost of overall bridge construction.

Among the prior art box girder type bridges, a streamlined box girder type proposed by Gilbert Roberts (Canadian Pat. No. 678,259) is well known. A bridge embodying Roberts' streamlined box girder type suspension bridge is known as the Severn Bridge of England built in 1966.

Roberts' streamlined box girder suspension bridge attempts to achieve stability against the wind by streamlining the girder cross section, and is basically based on a design concept of approximating the girder cross section to a slender streamline shape by reducing the girder depth as much as possible on the premise that the structural strength of the box girder is maximally utilized.

In the conventional truss stiffened girder suspension bridges, the girder depth becomes inevitably large because the girder rigidity is increased by trusses, thus proving economically disadvantageous compared to the streamlined box girder type. On the other hand, this type bridge is advantageous in that the bridge is less likely to be affected by the wind despite its large girder depth as the wind easily passes through the truss intervals.

Compared to such truss stiffened girder structure, the streamlined box girder type has various advantages since the girder strength is fully utilized because of the inherent rigidity of the box girder structure as above discussed. These advantages are; radically reduced volume and weight of steel by the reduction in girder depth; stability against the wind arising from the streamlined girder cross section; and extremely easy maintenance of the bridge such as painting.

Despite such several advantages of the streamlined box girder suspension bridge as above enumerated, there still exists a grave problem in this type suspension bridge that the bridge structure becomes extremely sensitive against the live loads and the wind drag. This problem is grave enough to offset the economic advantages over the truss girder type such as the radical reduction in the plate thickness and volume of steel used. To cite an example, if the weight of girder per se is decreased for purposes as mentioned above, aeolian oscillation or buffeting of fine amplitude generates to the girder by the constant wind of even a comparatively low velocity in addition to the rapid increase of traffic vibrations caused by live loads. The light weight and box shaped cross section of this type of girders deteriorate the damping capacity of the girder in absorbing the vibrations through its structure compared to the truss girder. A comparatively large stress repeatedly acts on the hangers and girders, thereby causing damage to the hangers or girders.

As the streamlined box girder type suspension bridge has the girder cross section which is streamlined like wings, if a comparatively large wind which occurs only infrequently acts on the girder and causes dangerous oscillation, the aerodynamic stability of the bridge reaches the maximum and destroys the bridge. This is called the bending-torsional flutter where bending and torsion occur to the girder concurrently.

Thus, the streamlined box girder type suspension bridge contains two contradictory elements; one is the economical advantage of achieving the dynamic stability without increasing thickness of the girder cross section since the cross section is streamlined to reduce the wind resistance; another is that the reduced inherent resistance against external oscillation elements with the less girder weight as the depth and plate thickness are reduced in size as well as the likelihood of catastrophic vibration such as bending-torsional flutter caused by the slender wing-like streamlined shape of the girder cross section.

SUMMARY OF THE INVENTION

The present invention offers a perfect streamlined box girder type suspension bridge by obviating the disadvantages which the stiffening girder type suspension bridge inherently contains and enabling a full use of its advantages.

Basically, the present invention obtains the static design conditions in the initial stage of static design which determine if the girder cross section is within the scope of permissible stresses or not under live loads such as moving vehicles or wind drag; it also analyzes the dynamic design conditions such as the onset wind velocity for the bending-torsional flutter which is induced by comparatively large but infrequently encountered wind and which may damage the girders. The invention then preliminarily adds to the girder weight obtained in the static design the weight necessary for controlling various aeolian oscillations as mentioned above as an additional mass.

When the means of adding the weight for oscillation control to the streamlined box type girders is contemplated as the dynamic design condition, there are two methods for adding the weight. One is adding in the stage of static design the mass secondarily to the girder which has been designed as having sufficient strength, the mass being materials as concrete, water or sand which is irrelevant to the girder strength. Another method is to add the weight necessary for dynamic design conditions so as to correct the girder conditions which have been determined by the static design conditions by increasing the girder depth or the plate thickness.

Of the two methods of adding weight to the girder, the first method according to the present invention places at an appropriate point in the girder cross section the mass by the amount necessary for controlling oscillations calculated under the dynamic design conditions, the mass being such that would not directly contribute to the strength of the girder which had been designed as having sufficient strength in the static design stage. Therefore, it suffices in the present invention if the girder structure is made to have the small girder depth, light weight and sufficient rigidity within the scope of the static design conditions to effectively utilize the advantages of the streamlined box girder.

By adding the mass to the girder cross section obtained in the stage of static design in such a way as to increase the weight of the girder, the present invention aims at extending the scope of durability against the onset velocity of bending-torsional flutter which is considered to occur frequently particularly in the streamlined box girder suspension bridge.

In order to delineate the properties of the bending-torsional flutters and to calculate the velocity which manifests bending-torsional flutters to the girder, Selberg's empirical formula may be modified as follows:

$$V = 38.12 \times \frac{(m \cdot I\theta)^{\frac{1}{4}}}{\left(\frac{B}{2}\right)^{\frac{1}{2}}} \omega\phi \sqrt{1 - \left(\frac{\omega\eta}{\omega\phi}\right)^2} \times C$$

In the above formula, V represents the expected onset velocity of the bending-torsional flutters, m·Iθ the mass and the polar moment of inertia per unit length of the girder respectively, $\omega\eta$ and $\omega\phi$ the vertical and torsional circular frequency respectively, B the width of the deck, C the correction factor for cross sectional shape of the girder, the factor being substantially 1.0 if the girder is a slender streamline. In order to improve the durability against the onset velocity of the flutters or to increase V, the girder mass or polar moment of inertia m·Iθ may be increased within the range not to radically decrease torsional circular frequency $\omega\phi$ or the frequency ratio $\omega\phi/\omega\eta$.

In the structure such as a suspension bridge, the above mentioned torsional circular frequency $\omega\phi$ decreases as the center span increases in length whether the box girder is streamlined or not. This will decrease the onset velocity V of the bending-torsional flutter relatively. The Humber Bridge in England has the longest center span in the world at 1,410 m among the suspension bridges of streamlined box girder type. However, if it is attempted to increase the center span beyond the above length without changing the current streamlined box girder structure, the durability against the onset velocity of the bending-torsional flutter becomes lowered. This is the reason why the center span of 1,410 m for the Humber Bridge is considered the longest achievable for the streamlined box girder type bridge.

The Selberg formula establishes the fact that the girder mass and polar moment of inertia m·Iθ may be increased within the scope not to lower the torsional circular frequency $\omega\phi$ of the girder in order to raise the onset velocity V of the binding-torsional flutter. Thus, it is considered theoretically possible to extend the center span beyond that of the Humber Bridge for the streamlined box girder suspension bridges built by the current construction method so long as the mass and the polar intertia moment m·Iθ is increased.

As mentioned heretofore, the present invention theorizes that the girder mass and polar moment inertia m·Iθ may be increased by secondarily adding to the girder structure obtained under the static design conditions the mass which is irrelevant to the girder strength. It is also possible to follow other methods such as increasing the girder depth or increasing the plate thickness of steel used to thereby improve the torsional rigidity of the girder and increase the torsional circular frequency $\omega\phi$. This results in increased onset velocity V of the bending-torsional flutter.

The basic concept of the streamlined box girder type suspension bridge, however, lies in that the wind resistance is minimized by decreasing the girder depth. When this is taken into consideration, increasing the girder depth in order to enhance the torsional rigidity of the girder will actually result in lowering of correction factor C for the cross sectional shape of the girder expressed by the Selberg formula to about 0.8 even though this may appear to have increased the onset velocity V of the bending-torsional flutter. For instance, if the girder depth is increased to improve the torsional circular frequency $\omega\phi$ by 20%, then the corrective factor for the cross sectional shape of the girder will decrease by 20%, thus bringing about a result far from the ideal streamlined box girder shaped suspension bridge. On the other hand, if the girder depth is increased, the air separation layer appears along the girder surface as the wind flows along said surface, and this in turn causes limited oscillations called the aeolian oscillation in the stage where the velocity is less than the onset velocity of the bending-torsional flutter. If the oscillation frequency is large, this may lead to a situation where the oscillation frequency may control the resistance of the suspension bridge against the wind.

If increasing the girder depth and enhancing the torsional rigidity of the girder is not an appropriate measure for the streamlined box girder type, then another means of enhancing the torsional rigidity of the girder by increasing the plate thickness of the steel automatically surfaces. However, this means is also defective because if the plate thickness alone was to be increased without increasing the girder depth of the box girder and the same degree of the torsional rigidity was to be imparted to the girder as in the case of larger girder depth, this will necessarily increase the plate thickness and the steel weight to the extent greater than the case of the truss reinforcing material, and consequently increase the cable thickness as well. This measure of increasing the plate thickness and enhancing torsional rigidity of the girder with a far larger steel weight cannot be appropriate and therefore incomparable to the case where the girder depth is increased or when the girders are reinforced by trusses.

Based on the premise that the correction factor C hardly changes in the Selberg formula, the girder mass or polar inertia moment m·Iθ may be increased by using such a material as concrete, water or sand which does not directly contribute to the girder strength, then the onset wind velocity for the bending-torsional flutter may be improved, to result in the construction of a suspension bridge having a far longer center span than that of Humber Bridge even when the currently available streamlined box girder structure is used.

The present invention thus improves the torsional rigidity of the streamlined box girder obtained under the static design conditions as above mentioned by adding appropriate mass which would not directly contribute toward the girder strength and which is within the scope that the torsional circular oscillations of the girder is now lowered. The above mentioned appropriate additional mass is preferably within the range not exceeding 50% of the total weight per unit length of the suspension bridge including girders and cables obtained under the static design conditions.

Provided that the mass to be added is within 50% of the total weight per unit length of the suspension bridge before addition, it was proven through the wind tunnel experiments that the onset velocity for the bending-torsional flutter can be improved by enhancing the torsional rigidity while the economic advantages of the streamlined box girder are fully utilized. If the mass to be added is over 50% of the total weight, the onset velocity is further improved, but the total weight including the girders and cables may exceed that of the truss stiffened girders. This is economically meaningless.

The point where the additional mass is to be positioned is within ¼ length of the bridge width from the girder center along the bridge axis in view of the effective range which hardly lowers the torsional circular oscillations of the girder.

BRIEF DESCRIPTION OF THE DRAWINGS

Other objects and advantages of the present invention will become more apparent from the following description taken in connection with the accompanying drawings in which.

DETAILED DESCRIPTION OF THE PREFERRED EMBODIMENTS

Figure 1:
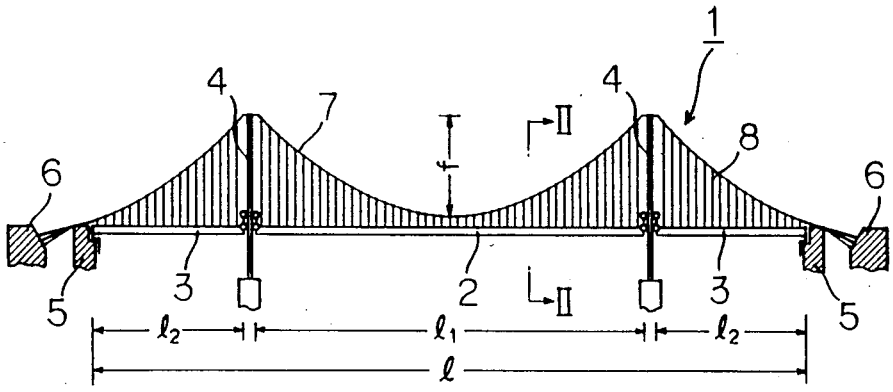
FIG. 1 is a side elevation of the preferred embodiment of the streamlined box girder type suspension bridge according to the present invention.

Throughout the following description and drawings, like reference numerals designate like or corresponding parts shown in multiple figures of the drawing.

Referring now to the drawings and to FIG. 1 in particular, there is illustrated a streamlined box girder type suspension bridge designated at numeral 1 including a stiffening girder. In the preferred embodiment of the present invention, the stiffening girder of the bridge 1 is constituted by a hollow closed box having streamlined sides, said stiffening girder including a main span 2 of 2,000 m length and side spans 3 of 600 m to 1,000 m length respectively. As shown in this embodiment, a side to center span ratio of this bridge is 0.3 to 0.5.

The stiffening girder is suspended from cables 7 by a number of hangers 8 and supported by a plurality of towers 4. Said towers 4 are emplaced in a spaced relation to each other with a predetermined distance $\mathbf{1}_1$. Embedded in a spaced relation to the towers 4 with a predetermined distance $\mathbf{1}_2$ are abutments 5 at which the end of each of the side spans 3 outside the towers 4 at the extremities of the main span 2 are arranged. The above-mentioned cables 7 are supported by the towers 4 so as to maintain a predetermined sag (f) and anchored to anchorages 6 embedded outside the abutments 5. Tension of the cables 7 is maintained by abutments 5. Said sag span ratio in this embodiment is 1/8.5.

Figure 2:
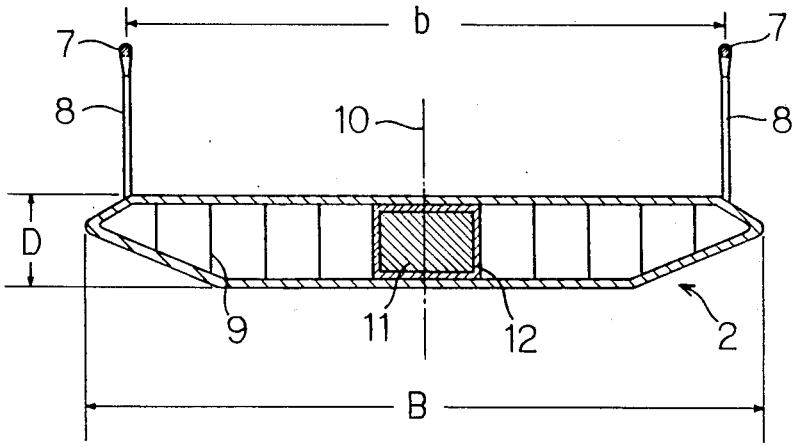
FIG. 2 is a cross section on a large scale taken along the line II—II of FIG. 1.

FIG. 2 illustrates in cross section the streamlined box girder type suspension bridge 1. A plurality of internal transverse stiffening frames 9 are arranged in the stiffening girder.

Table 1 below shows the sectional values of the members determined under the static design conditions which comprise the model for the above mentioned streamlined box girder type suspension bridge 1.

TABLE 1

Elements for Basic Design
Suspension Bridge Models (per bridge)

| | | | | |
|---|---|---|---|---|
| Sag Span Ratio | | | — | 1/8.5 |
| Side to Center Span Ratio | | | — | 0.5–0.3 |
| Weight | Cable | Wc | t/m | 12.5 |
| | Stiffening Girder | Wf | t/m | 22.0 |
| | Total Weight | W | t/m | 34.5 |
| Polar Moment of Inertia | | $I\theta$ | $t \cdot m \cdot s^2/m$ | 593.8 |
| Cable | Distance of Cable | b | m | 32.0 |
| | Sectional Area of Cable | Ac | $m^2$ | 1.39 |
| | Cable Sag | f | m | 232.9 |
| | Horizontal Component of the Cable Tension | Hw | t | 72592 |
| Stiffening Girder | Vertical Flexual Rigidity | EI | $t \cdot m^2$ | $0.17 \times 10^9$ |
| | Torsional Rigidity | GJ | $t \cdot m^2$ | $0.14 \times 10^9$ |

Based on the above suspension bridge model, three different models were assumed by citing three different weights consisting of comparatively inexpensive materials which do not contribute to the girder rigidity.

Weights $\Delta W = 3$ t/m/bridge $\Delta W = 6$ t/m/bridge $\Delta W = 9$ t/m/bridge The models are shown in Table 2. These three different weights are, as shown in FIG. 2, provided as predetermined mass 11 within a core 12 formed on the stiffening girder cross section at $\mathbf{1}_1$ $\mathbf{1}_2$ of all the spans of the bridge 1. The additional mass 11 consists of a material such as concrete, and its weight is to be within the range not exceeding 50% of the total weight W (34.5 k/m/bridge) including girders and cables of the basic design bridge model shown in Table 1 per unit length In this case, the core 12 is arranged centrally symmetrically with respect to the longitudinal axis 10 of the bridge 1 so as to minimize the additional polar moment of inertia of the stiffening girder due to the additional load 11. The concrete may be filled in the core 12 in any desired manner. For instance, it may be cast into the core 12.

Figure 3:
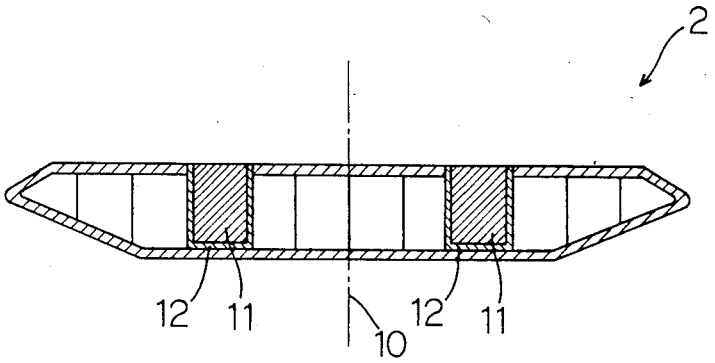
FIGS. 3 to 4 show another embodiment of the streamlined box girder type suspension bridge according to the present invention.
Figure 4:
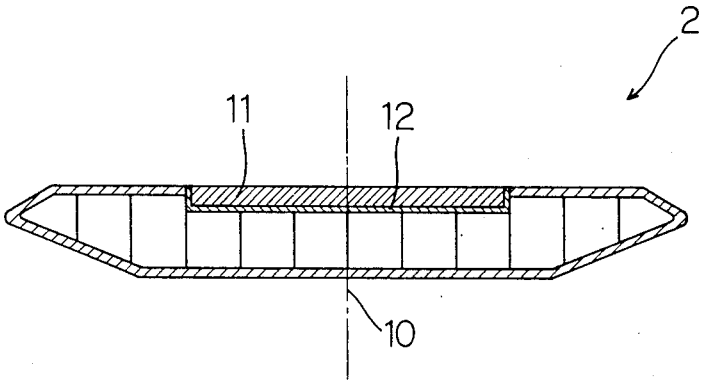

FIGS. 3 and 4 show other modifications of the present invention. In FIG. 3, the cores 12 are symmetrically positioned at the predetermined positions on both sides of the girder center. In FIG. 4, the core 12 is formed at the upper portion of the stiffening girder, serving to constitute the deck of the bridge 1.

Table 2 below shows the sectional values of three suspension bridge models to which the three different additional masses 11 are respectively added to the stiffening girder.

TABLE 2

Sectional Values of Suspension Bridge Models to Which Additional Masses are Added (per bridge)

| | | | | | | |
|---|---|---|---|---|---|---|
| Sag Span Ratio | | | — | | 1/8.5 | |
| Side to Center Span Ratio | | | — | 0.5-0.3 | 0.5-0.3 | 0.5-0.3 |
| Weight | Cable | Wc | t/m | 14.0 | 15.1 | 16.9 |
| | Stiffening Girder | Wf | t/m | 22.0 | 22.0 | 22.0 |
| | Additional Mass | ΔW | t/m | 3.0 | 6.0 | 9.0 |
| | Total Weight | W | t/m | 39.0 | 43.4 | 47.9 |
| Polar Moment of Inertia | | Iθ | $t \cdot m \cdot s^2/m$ | 633.0 | 669.6 | 708.8 |
| Cable | Distance of Cable | b | m | 32.0 | 32.0 | 32.0 |
| | Sectional Area of Cable | Ac | $m^2$ | 1.55 | 1.71 | 1.87 |
| | Cable Sag | f | m | 232.9 | 232.9 | 232.9 |
| | Horizontal Component of the Cable Tension | Hw | t | 82061 | 91319 | 100787 |
| | Vertical Flexual Rigidity | EI | $t \cdot m^2$ | $0.17 \times 10^9$ | $0.17 \times 10^9$ | $0.17 \times 10^9$ |
| | Torsional Rigidity | GJ | $t \cdot m^2$ | $0.14 \times 10^9$ | $0.14 \times 10^9$ | $0.14 \times 10^9$ |

As shown in FIG. 2, the ratio of the bridge width B and the girder depth D is $$B/D = 38/6 \approx 6.3$$

If the girder depth is increased farther and the torsional rigidity improved, there occurs torsional aeolian oscillations of a large frequency to the girder. It is therefore assumed that it is inappropriate to increase the girder depth any farther. Increased girder depth will also act to lower the correction factor C for the cross sectional shape. The total weight 47.9 t/m/bridge per unit length, when the heaviest weight of the above three additional mass 11 (ΔW=9 t/m/bridge) is added according to the present invention, assumes that it is substantially equal to the dead weight of the truss stiffened girder suspension bridge which was designed under approximately same conditions. Therefore, the weight of steel used for the girders per se in the present invention is less than that of the truss girder type, demonstrating an apparent economical advantage.

Figure 5:
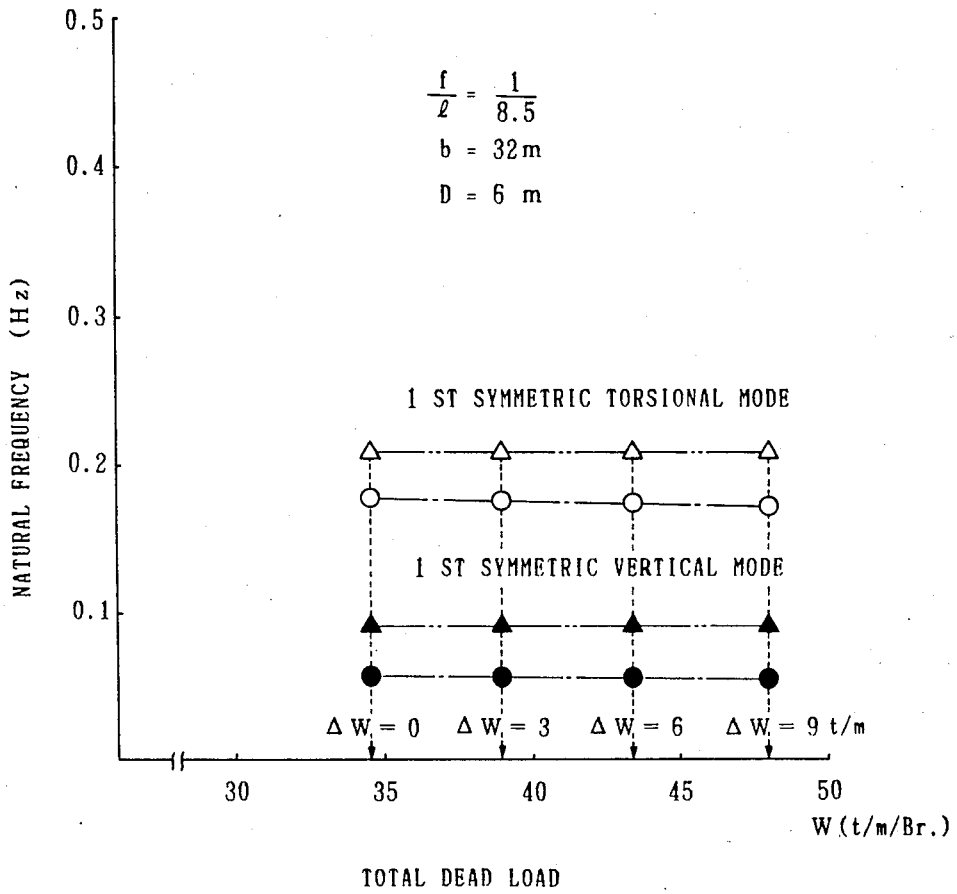
FIG. 5 is a graphical representation showing the relation between the total weight and the first symmetric frequency (lowest frequency)

FIG. 5 shows the relation between the total weight and the lst symmetric frequency for the three types of suspension bridges shown in Table 2. In this figure, the weight 34.5 t/m wherein ΔW=0 represents the weight at the stage of static design without the addition of the mass 11. The figure demonstrates that frequency hardly becomes lowered if the respective masses 11 are added near the center of the box girder.

Figure 6:
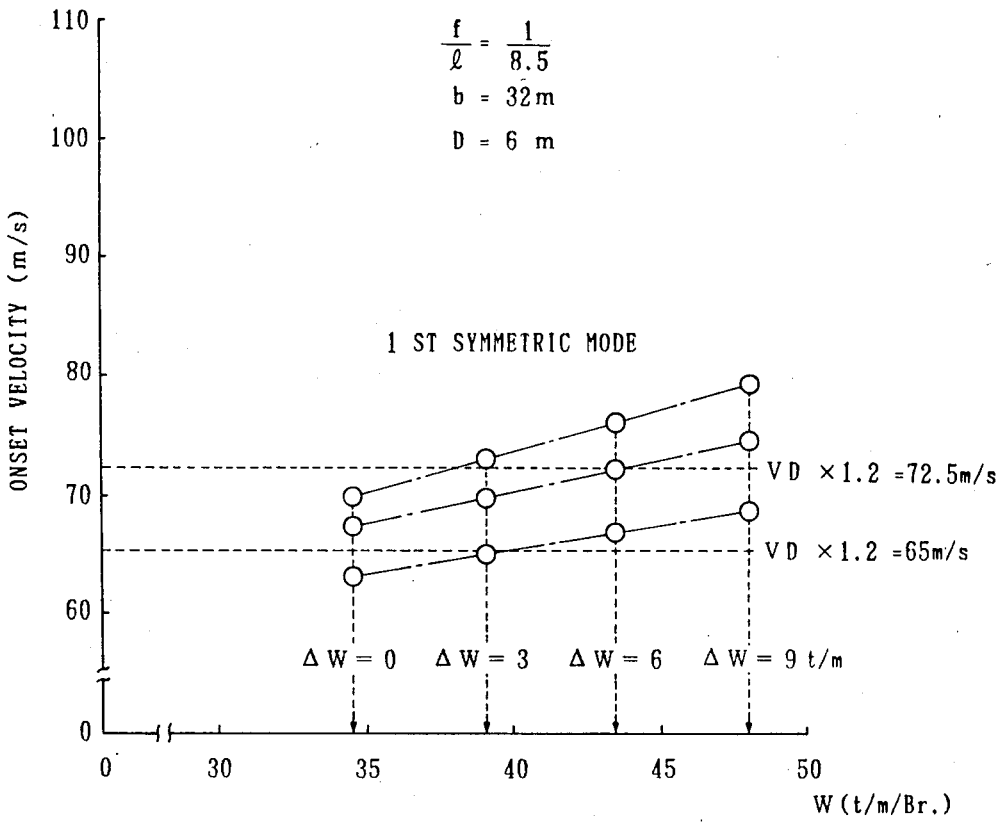
FIG. 6 is a graphical representation showing the effect of total weight on the onset velocity of bending-torsional flutter.

FIG. 6 shows the onset wind velocity for bending-torsional flutters calculated by the Selberg formula. For simplicity's sake, the correction factor was assumed to be C=0.1. FIG. 6 demonstrates that the total weight increased by adding the mass 11 to the center of box girder will raise the onset velocity of bending-torsional flutter irrespective of the side to center span ratio. The wind velocity which exceeds the onset velocity varies dependant on the natural wind conditions at site. Therefore, the required wind velocities V of 72.5 m/s and 65 m/s are conceived.

Figure 7:
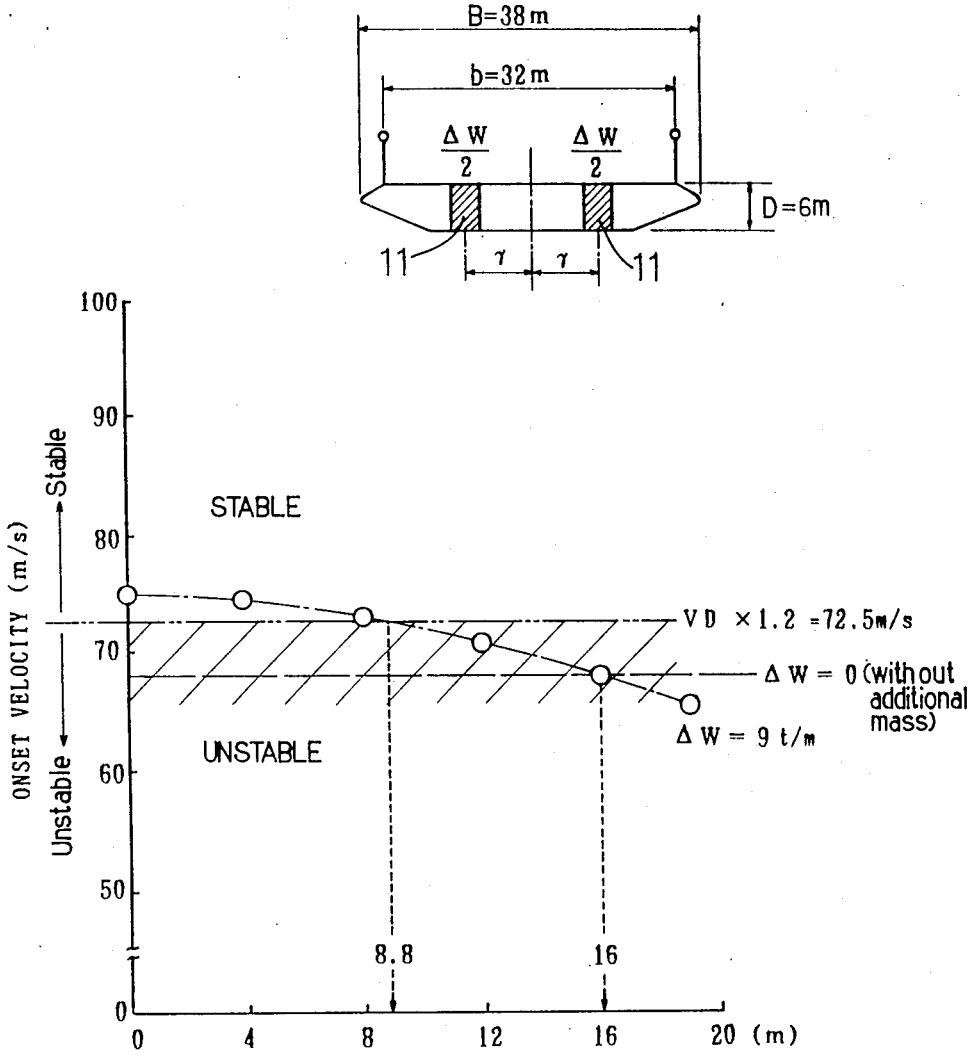
FIG. 7 is a graphical representation showing the relation between the location of the additional mass and onset velocity of the bending-torsional flutter.

Of the additional masses 11, ΔW=9 t/m/bridge was taken up as an example in reviewing the optimum location at which the mass is to be added. FIG. 7 shows the relation between the location Y for adding the mass and the onset velocity of bending-torsional flutter. When the location γ at which the mass is to be added moves farther than about 9 m (or 8.8 m) from the center of the girder, the onset velocity of bending-torsional flutter enters the unstable region as it does not satisfy the prescribed wind velocity 72.5 m/s. Therefore, so long as the location at which the additional mass 11 is to be provided is designed to be within the distance of about 9 m from the center of girder, the value of $\gamma \approx 9$ m is within a stable range which is above the velocity of 72.5 m/s as mentioned above. The value $\gamma \approx 9$ m is somewhat smaller than B/4=9.5 as the bridge width (B) is 38 m. This fact demonstrates that the position to add the mass 11 is effectively elected if $\gamma \leqq B/4$.

On the other hand, if the additional mass is located at $\gamma > B/4$, or a point beyond 9 m in FIG. 7, the onset velocity of the bending-torsional flutter begins to decline rapidly. If it goes beyond γ=16 m, it will be less than the onset velocity without the additional mass 11. The above description suggests that the location for the additional mass 11 should preferably be near the center of the box girder. However, it would be more effective in view of construction properties and the above mentioned computation examples that the locations γ be placed symmetrically below (i.e., within) B/4 from the center of the box girder as illustrated in FIG. 3.

What is claimed is:

1. In a stiffening girder type suspension bridge comprising a plurality of towers emplaced in spaced relation with each other; cables adapted to be supported by said towers with both ends of said cables being anchored to abutments; a center main span comprising streamlined box girder hung from said cables by a plurality of hangers; and side spans co-axial with the main span, the bridge having a central longitudinal axis along which said center main span and side spans extend, the improvement wherein:

a predetermined additional mass is incorporated in the streamlined box girder and extending along the length thereof, said additional mass being of a weight not exceeding 50% of the total weight of said suspension bridge including girders and cables per unit length and obtained under static design conditions as suppressing the bending-torsional flutters caused by the streamlined shape of said box girder, the weight being added secondarily to said box girder being a material not directly contributing to the girder strength obtained in the stage of static design; and said additional mass being arranged substantially symmetrically with respect to said longitudinal axis of the bridge and being positioned width-wise of the bridge within a range which extends to $\frac{1}{4}$ of the bridge width from the center of said box girder along said longitudinal axis.

2. The stiffening girder type suspension bridge of claim 1 wherein the additional mass consists of concrete.

3. The stiffening girder type suspension bridge of claim 1 comprising a core formed in the central portion of the streamlined box girder, said core being provided with the additional mass.

4. The stiffening girder type suspension bridge of claim 3 wherein the additional mass consists of concrete.

5. The stiffening girder type suspension bridge of claim 1 comprising a core formed at symmetrical locations away from the center of the streamlined box girder type by a predetermined interval, said core being provided with the additional mass.

6. The stiffening girder type suspension bridge of claim 5 wherein the additional mass consists of concrete.

7. The stiffening girder type suspension bridge of claim 1 comprising a core formed in the upper portion of the streamlined box girder, said core being provided with the additional mass.

8. The stiffening girder type suspension bridge of claim 7 wherein the additional mass consists of concrete.

* * * * *